United States Patent [19]

Lof

[11] 4,196,783

[45] Apr. 8, 1980

[54] DEVICE FOR BORING

[75] Inventor: Stig U. Löf, Lysvik, Sweden

[73] Assignee: Lofs Verkstads AB, Sunne, Sweden

[21] Appl. No.: 923,535

[22] Filed: Jul. 11, 1978

[51] Int. Cl.[2] ..... E21B 17/10

[52] U.S. Cl. ..... 175/408; 55/482; 175/398

[58] Field of Search ..... 175/171, 173, 408, 257, 175/398, 402, 314, 92, 215, 399, 65, 400, 209, 210, 211; 55/482

[56] References Cited

U.S. PATENT DOCUMENTS

| | | | |
|---|---|---|---|
| 791,264 | 5/1905 | Hardsoog | 175/207 |
| 1,220,739 | 3/1917 | Freeon | 175/398 X |
| 2,485,826 | 10/1949 | Harinck | 175/171 X |
| 3,220,742 | 11/1965 | Moates | 175/207 |
| 3,277,972 | 10/1966 | Lagerstrom | 175/399 |
| 3,370,658 | 2/1968 | Jansson | 175/215 |
| 3,682,260 | 8/1972 | Klemm | 175/92 |
| 3,848,683 | 11/1974 | Persson | 175/171 |
| 3,914,196 | 3/1976 | Curington et al. | 175/215 |

FOREIGN PATENT DOCUMENTS

| | | | |
|---|---|---|---|
| 1483874 | 12/1969 | Fed. Rep. of Germany | 175/173 |

*Primary Examiner*—James A. Leppink
*Assistant Examiner*—Richard E. Favreau
*Attorney, Agent, or Firm*—Hane, Roberts, Spiecens & Cohen

[57] ABSTRACT

Boring apparatus comprising a tubular casing containing a cylindrical body adapted for being driven by a boring rod and a filter body adjacent the cylindrical body. A boring tool is mounted outside the tubular casing at the end of the filter body. The filter body has a cross-section of polygon shape with axially extending edges in contact with the inner surface of the tubular casing to define clearance spaces between the inner surface of the tubular casing and the outer surface of the filter body. The cylindrical body has axial grooves extending to the clearance spaces for passage of boring particles. The cylindrical body can also be provided with annular grooves. Preferably, the cylindrical body and filter body are constituted as a single unit.

7 Claims, 2 Drawing Figures

DEVICE FOR BORING

FIELD OF THE INVENTION

The invention relates to a boring cutter holder such as of the type described in Swedish Pat. No. 377,706.

PRIOR ART

In this Swedish patent there is disclosed a cylindrical filter body next to a tubular casing so that a ring-shaped slot is formed between the filter body and the tubular casing. The filter body is kept centered by a number of guide ribs. A cutter head is then fastened at the bottom end of the filter body. It has proved very difficult to keep the filter body centered in the tubular casing.

SUMMARY OF THE INVENTION

An object of the present invention is to provide a holder which avoids the above disadvantage by the provision of a bearing support between the filter body and the tubular casing. This is accomplished by giving the filter body the cross-section of a polygon where the surface edges of the filter body bear against the tubular casing, and where the surface edges form a slide bearing together with the tubular casing. If the filter body has a hexagonal cross-section, this will produce six consecutive slots for the passage of boring particles. Looking towards the top opening of the tubular casing, the filter body may be followed by a second body which may be completely cylindrical. The cylindrical surface is used to act as a slide bearing with the inside surface of the tubular casing. The outer surface of the second body is provided with a number of axial tracks for the further transportation of boring particles from the slots created by the filter body. The filter body is best firmly united with the following second body and may possibly be manufactured as a unit. The filter body may be provided along its periphery with tracks of any cross-section. These peripheral tracks may be used to prevent the jamming of boring particles passing through the channels formed by the filter body.

BRIEF DESCRIPTION OF THE DRAWING

The device will be further described in conjunction with the drawing showing the lower part of the device.

DETAILED DESCRIPTION

Figure 1:
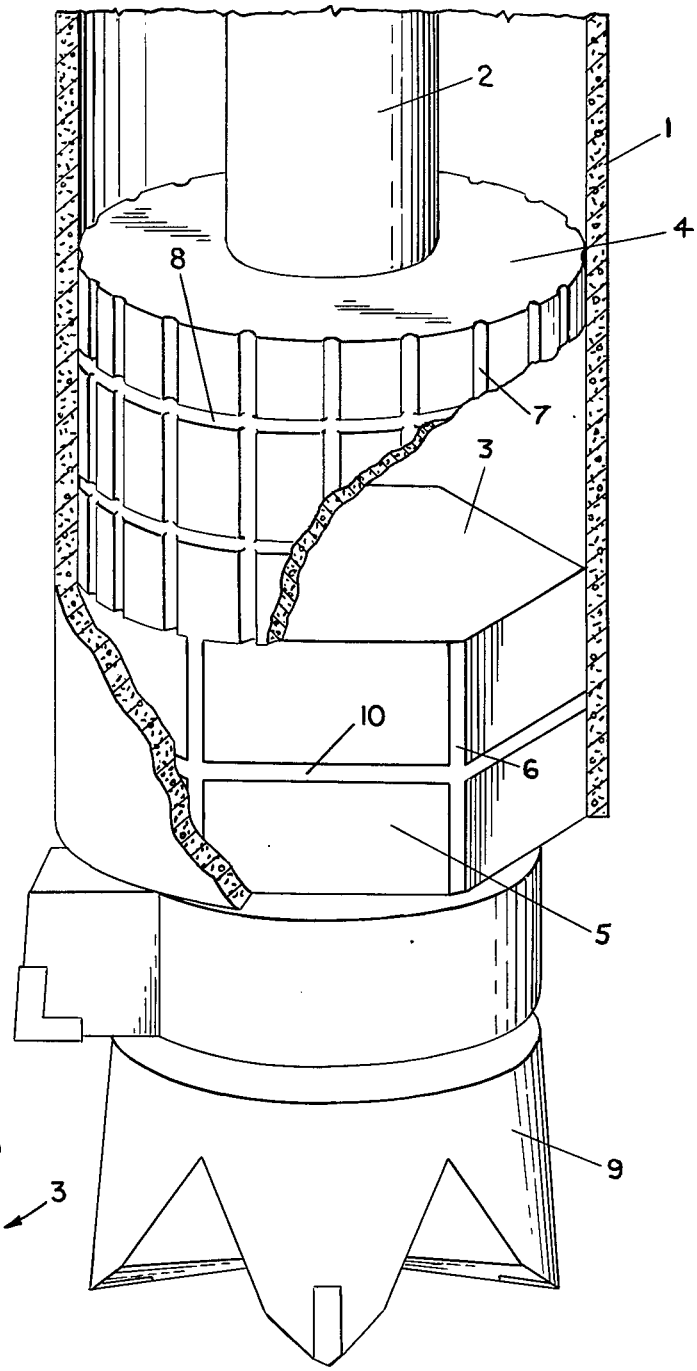
FIG. 1 is a perspective view, partly broken away and in section, of the lower part of the device.
Figure 2:
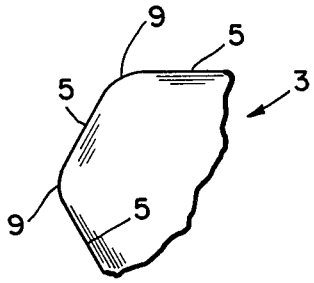
FIG. 2 is a top plan view of a portion of the filter body of the device.

In the drawing, there is seen a length of tubular casing (1) inside which is a section (2) of connected boring rods. This section (2) is connected to a filter body (3) via a second cylindrical body (4). The filter body is prismatic in shape, and in the present instance the filter body has a hexagonal cross-section. The filter body therefore has six planar sides (5). Between two sides (5) the filter body (3) has a contact edge (6) which bears against the inside surface of the tubular casing (1). Between the tubular casing and the filter body there are thus six channels with the cross-section of a segment of a circle. The edges of the filter body (3) bearing against the inside surface of the tubular casing (1) may have a contact surface whose cross-section is bow-shaped as seen at 9 in FIG. 2 and which wholly or partly press against the inside surface of the tubular casing.

The body (4) which is cylindrical in shape is provided with a number of axial tracks (7) which open out into the channels formed between the sides (5) of the filter body (3) and the inside surface of the tubular casing. The body (4) is also provided with a number of peripheral tracks (8). The filter body (3) can also be provided with peripheral tracks similar to peripheral tracks (8) and one such track is shown at 10.

Filter body (3) and body (4) are preferably manufactured as a single unit. A boring tool (9) is seated at the bottom end of the filter body (3).

What is claimed is:

1. Boring apparatus comprising a tubular casing, a cylindrical body in said casing adapted for being driven by a boring rod, a filter body disposed in said casing adjacent said cylindrical body and a boring tool mounted outside said tubular casing after said filter body, said filter body having a polygonal multi-sided cross-section with axially extending edges in contact with the inner surface of the tubular casing to define clearance spaces between the inner surface of the tubular casing and the outer surface of the filter body, said filter body and tubular casing constituting a slide bearing and centering means for the boring tool.

2. Boring apparatus as claimed in claim 1 wherein said edges of the filter body are bow-shaped.

3. Boring apparatus as claimed in claim 1 wherein said filter body is provided with at least one peripheral groove.

4. Boring apparatus as claimed in claim 3 wherein said filter body has a surface remote from said boring tool which is united with said cylindrical body.

5. Boring apparatus as claimed in claim 4 wherein said cylindrical body has a plurality of axial grooves for passage of boring particles, said axial grooves extending to said clearance spaces.

6. Boring apparatus as claimed in claim 5 wherein said cylindrical body has a plurality of annular grooves.

7. Boring apparatus as claimed in claim 5 wherein said filter body and cylindrical body are constituted as a single unit.

* * * * *